US010894422B2

(12) United States Patent
Koganehira

(10) Patent No.: US 10,894,422 B2
(45) Date of Patent: Jan. 19, 2021

(54) CONSUMABLES CONSUMPTION APPARATUS AND CONSUMABLES CONSUMPTION SYSTEM

(71) Applicant: SEIKO EPSON CORPORATION, Tokyo (JP)

(72) Inventor: Shuichi Koganehira, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/575,041

(22) Filed: Sep. 18, 2019

(65) Prior Publication Data

US 2020/0094568 A1 Mar. 26, 2020

(30) Foreign Application Priority Data

Sep. 20, 2018 (JP) ..... 2018-175746

(51) Int. Cl.
*B41J 2/175* (2006.01)

(52) U.S. Cl.
CPC ..... *B41J 2/17543* (2013.01); *B41J 2/17503* (2013.01); *B41J 2/17566* (2013.01); *B41J 2/1752* (2013.01); *B41J 2/1753* (2013.01); *B41J 2/17523* (2013.01); *B41J 2/17546* (2013.01); *B41J 2/17553* (2013.01); *B41J 2002/17569* (2013.01)

(58) Field of Classification Search
CPC ..... B41J 2/17543; B41J 2/17566; B41J 2002/17569; B41J 2/17553; B41J 2/17546; B41J 2/17523; B41J 2/1753; B41J 2/1752; B41J 2/17503
See application file for complete search history.

(56) References Cited

U.S. PATENT DOCUMENTS

2010/0290791 A1* 11/2010 Sonoda ..... G03G 15/55 399/12
2012/0075392 A1* 3/2012 Shirono ..... B41J 2/17506 347/86
2016/0139537 A1* 5/2016 Kasai ..... G03G 15/0863 399/12

FOREIGN PATENT DOCUMENTS

JP 2007-199479 A 8/2007
JP 2007199479 A * 8/2007 ..... G03G 21/00

* cited by examiner

*Primary Examiner* — Yaovi M Ameh
(74) *Attorney, Agent, or Firm* — Oliff PLC

(57) ABSTRACT

A consumables consumption apparatus includes a cartridge determination section that determines one of a specified cartridge and an unspecified cartridge which is attached to the consumables consumption apparatus in accordance with maintenance subject information indicating a subject of a maintenance contract and a notification section that requests a selection of one of use agreement of the unspecified cartridge and replacement of the unspecified cartridge by the specified cartridge when the cartridge determination section determines that the unspecified cartridge is attached and that makes a notification indicating at least one of information on cancellation of the maintenance contract and information on replacement by the specified cartridge when the use agreement is selected.

11 Claims, 9 Drawing Sheets

CONSUMABLES CONSUMPTION APPARATUS AND CONSUMABLES CONSUMPTION SYSTEM

The present application is based on, and claims priority from JP Application Serial Number 2018-175746, filed Sep. 20, 2018, the disclosure of which is hereby incorporated by reference herein in its entirety.

BACKGROUND

1. Technical Field

The present disclosure relates to a consumables consumption apparatus to which cartridges capable of accommodating consumables are attached.

2. Related Art

As consumables consumption apparatuses to which cartridges capable of accommodating consumables are attached, various apparatuses including printers to which cartridges accommodating ink are attached and photocopiers to which cartridges accommodating toners are attached are used, for example. For such a consumables consumption apparatus, a cartridge which guarantees an operation of the consumables consumption apparatus when being attached may be specified by a manufacturer of the consumables consumption apparatus (hereinafter referred to as a "specified cartridge"). Information for identifying a subject of a maintenance contract is added to the specified cartridge. When a cartridge which is different from such a specified cartridge (hereinafter referred to as an "unspecified cartridge") is attached, an operation of the consumables consumption apparatus may fail. Therefore, the maintenance contract of the consumables consumption apparatus is made on the assumption of use of a specified cartridge, and a provision for cancellation of the maintenance contract at a time when an unspecified cartridge is used may be made. Japanese Unexamined Patent Application Publication No. 2007-199479 discloses a technique of warning a user by causing a consumables consumption apparatus to display a predetermined message or the like before use of an unspecified cartridge, such as a pirated cartridge or a refilled cartridge, when the cartridge is attached.

According to Japanese Unexamined Patent Application Publication No. 2007-199479, in a state in which an unspecified cartridge is attached and used and thereafter is replaced by a specified cartridge, if a failure occurs due to past usage of the unspecified cartridge, the user misunderstands that services defined by a maintenance contract may be still available since the specified cartridge is currently used although the maintenance contract has been canceled due to the use of the unspecified cartridge in the past.

SUMMARY

The present disclosure is realized as the following embodiment.

According to an aspect of the present disclosure, there is provided a consumables consumption apparatus to which a specified cartridge which has maintenance subject information indicating a subject of a maintenance contract and which is capable of accommodating consumables or an unspecified cartridge which does not have the maintenance subject information and which is capable of accommodating the consumables is selectively attached. The consumables consumption apparatus includes a cartridge determination section that determines one of the specified cartridge and the unspecified cartridge which is attached to the consumables consumption apparatus in accordance with the maintenance subject information, and a notification section that requests a selection of one of use agreement of the unspecified cartridge and replacement of the unspecified cartridge by the specified cartridge when the cartridge determination section determines that the unspecified cartridge is attached, and makes a notification indicating at least one of information on cancellation of the maintenance contract and information on replacement by the specified cartridge when the use agreement is selected.

DESCRIPTION OF EXEMPLARY EMBODIMENTS

A. First Embodiment

Figure 1:
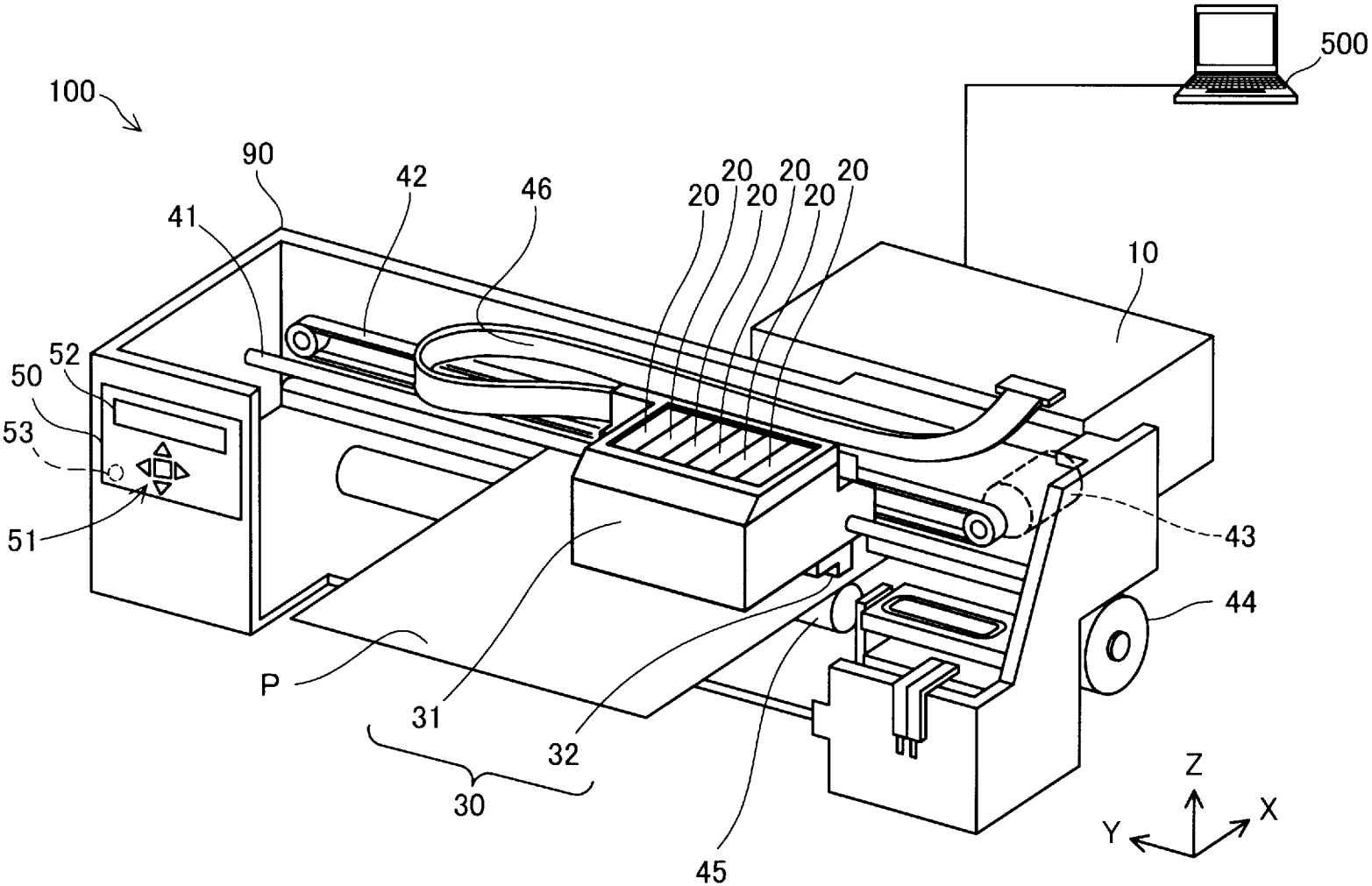
FIG. 1 is a perspective view schematically illustrating a configuration of a printer serving as a consumables consumption apparatus according to an embodiment of the present disclosure.

A1. Configuration of Apparatus:

FIG. 1 is a perspective view schematically illustrating a configuration of a printer 100 serving as a consumables consumption apparatus according to an embodiment of the present disclosure. In FIG. 1, a portion of the printer 100 is broken so that an internal configuration of the printer 100 is revealed. In FIG. 1, a Z axis is set in parallel to a vertical direction. Furthermore, an X axis and a Y axis are set so that an X-Y plane is in parallel to a horizontal direction. A +Z direction indicates a vertically upward direction, and a −Z direction indicates a vertically downward direction. X, Y, and Z axes described below with reference to the drawings are set along the X, Y, and Z axes of FIG. 1, respectively.

In this embodiment, the printer 100 is an ink jet printer which forms an image on a print medium P by ejecting ink droplets. The printer 100 is electrically coupled to a print control apparatus 500 and forms an image on the print medium P based on print data transmitted from the print control apparatus 500. Although the print medium P is a print sheet in this embodiment, the print medium P is not limited to a print sheet and an arbitrary printable medium, such as a label or fabric, may be used. The printer 100 is capable of ejecting ink droplets of a plurality of colors. Specifically, the printer 100 may eject inks of six colors (six types) in total including black, yellow, magenta, light magenta, cyan, and light cyan. Note that an arbitrary number of types of ink may be ejected instead of the six types. The ink is charged to the printer 100 when a user attaches cartridges 20 described below which accommodate respective colors of ink to the printer 100 in a detachable manner. The printer 100 is disposed on a plane which is parallel to a horizontal plane, such as a top plane of a desk, when being used.

The printer 100 includes a carriage 30, a transport rod 41, a driving belt 42, a carriage motor 43, a transport motor 44, a platen 45, a flexible cable 46, an operation section 50, a controller 10, and six cartridges 20 which are accommodated inside a case 90 or which are exposed in portions thereof to an outer surface of the case 90.

The carriage 30 includes a holder 31 and a print head 32. In this embodiment, the printer 100 is a so-called on-carriage type printer, and includes the cartridges 20 mounted on the carriage 30 which reciprocates in a scanning direction. In this embodiment, the scanning direction is in parallel to the Y axis. Six cartridges 20 are attached to the holder 31 at maximum in a detachable manner. In FIG. 1, six cartridges 20 are attached to the holder 31.

Figure 2:
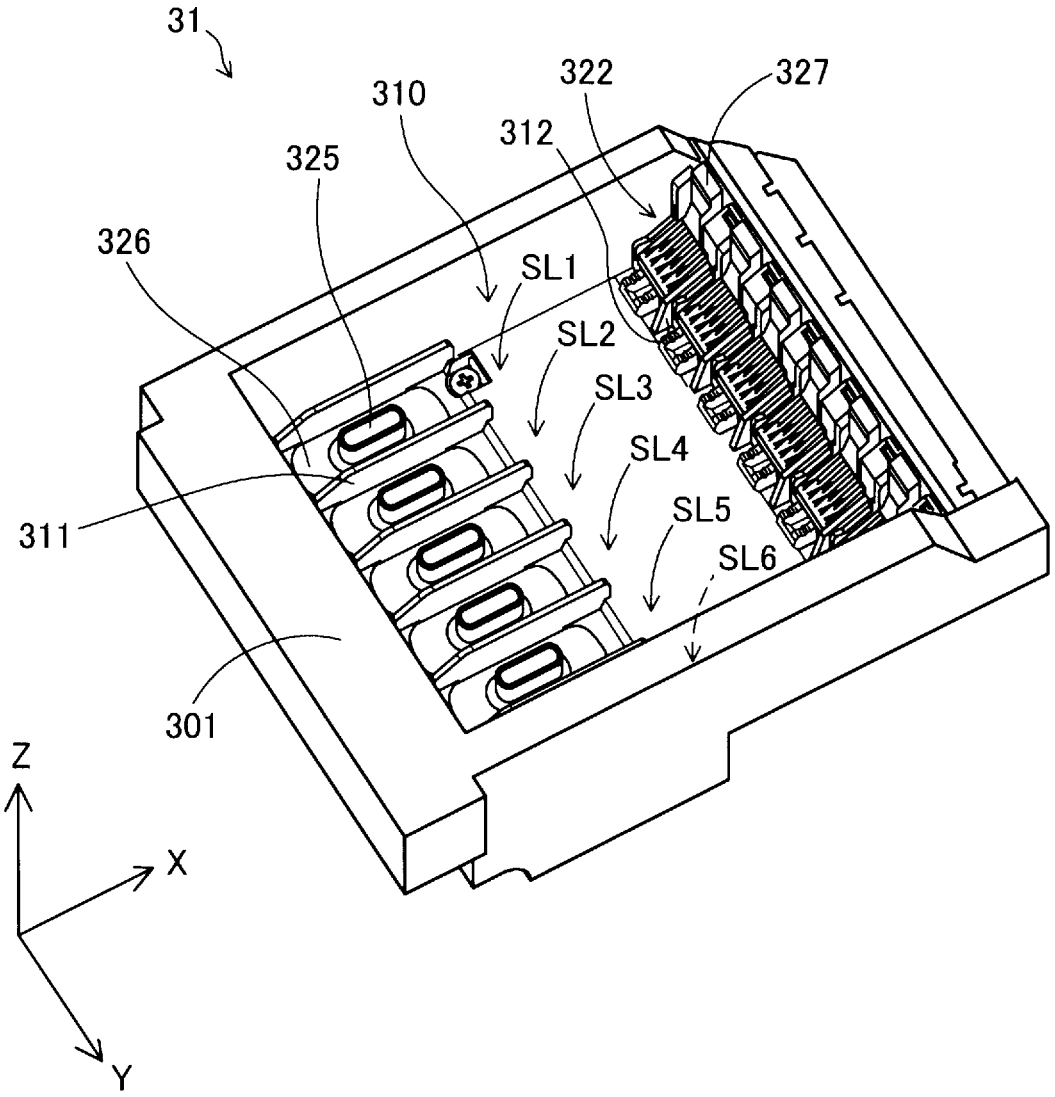
FIG. 2 is a perspective view illustrating a configuration of a holder in detail.

FIG. 2 is a perspective view illustrating a configuration of the holder 31 in detail. The holder 31 includes a holder main body section 301, seven first partition plates 311, seven second partition plates 312, six ink intake sections 325, six elastic members 326 corresponding to the ink intake sections 325, six electrode sections 322, and six holder engagement sections 327.

A cartridge accommodation chamber 310 which is opened in the +Z direction is formed in the holder main body section 301. The cartridge accommodation chamber 310 includes six slots SL1 to SL6 in total which accommodate the respective cartridges 20. The slots SL1 to SL6 are disposed in parallel to the Y axis. The slots SL1 to SL6 are divided by the first partition plates 311 and the second partition plates 312. Note that one of the first partition plates 311 and one of the second partition plates 312 which are located in a portion in the most +Y direction are omitted in FIG. 2. The slots SL1 to SL6 have the same configuration. Specifically, the ink intake sections 325 and the elastic members 326 are disposed in the vicinity of end portions of the slots SL1 to SL6 in the −X direction, and the electrode sections 322 and the holder engagement sections 327 are disposed in the vicinity of end portions of the slots SL1 to SL6 in the +X direction. Note that a configuration of the slot SL6 is omitted in FIG. 2.

The ink intake sections 325 guide the ink supplied from the cartridges 20 to the print head 32. The ink intake sections 325 have a tubular appearance shape and project from the cartridge accommodation chamber 310 in the +Z direction. The ink intake sections 325 are inserted into liquid supply sections 24 of the cartridges 20 described below in a state in which the cartridges 20 are attached to the holder 31 (hereinafter referred to as an "attached state" where appropriate). The elastic members 326 are disposed so as to surround the ink intake sections 325. The elastic members 326 seal the liquid supply sections 24 of the cartridges 20 described below in the attached state so that the ink is prevented from being leaked from the ink intake sections 325 and the liquid supply sections 24 to the cartridge accommodation chamber 310 and suppresses flow of air to the ink intake sections 325. In this way, the ink which remains in the holder 31 and the print head 32 may be prevented from being evaporated or fixed as dried ink.

Each of the electrode sections 322 has a plurality of terminals and is in contact with a corresponding one of circuit substrates 22 described below included in the cartridges 20 in the attached state. Furthermore, the individual electrode sections 322 are electrically coupled to the flexible cable 46. Therefore, the controller 10 may read data from the circuit substrates 22 and write data to the circuit substrates 22 in the attached state. Furthermore, the controller 10 may detect the cartridges 20 attached to the holder 31.

The holder engagement sections 327 are disposed adjacent to the respective electrode sections 322 in the +X direction. The individual holder engagement sections 327 are engaged with first engagement sections 25 described below included in the cartridges 20 in the attached state so as to fix the cartridges 20 in the corresponding slots SL1 to SL6.

The print head 32 of FIG. 1 includes a large number of nozzles, not illustrated, which are opened in the vertically downward direction, and ink drops are ejected from the nozzles to the print medium P.

The transport rod 41 has an appearance shape of a thin rod and is disposed in parallel to the scanning direction. The transport rod 41 supports the carriage 30 in the scanning direction such that the carriage 30 is movable. The driving belt 42 is an endless belt and is disposed in parallel to the transport rod 41. The carriage 30 is attached to the driving belt 42. The carriage motor 43 drives the driving belt 42. The carriage 30 reciprocates in the scanning direction when the driving belt 42 is driven. The transport motor 44 drives the platen 45 in a rotatable manner. The platen 45 has a cylindrical appearance shape and has a center axis extending in parallel to the scanning direction. The platen 45 is positioned below the print medium P in the vertical direction and is in contact with the print medium P. When the platen 45 is driven in a rotatable manner, the print medium P is transported in a sub-scanning direction. The sub-scanning direction is orthogonal to the main scanning direction, and is in parallel to an X axis in this embodiment. The flexible cable 46 electrically connects the carriage 30 to the controller 10.

The operation section 50 is disposed on a front surface of the case 90 while being exposed. The operation section 50 includes an operation button 51, a display section 52, and a speaker 53. The operation button 51 accepts an operation of selecting one of the menus displayed in the display section 52 and determining the selection performed by the user. The display section 52 displays, in addition to a menu screen, an error screen, a warning screen, and a ready screen. The error screen is used to display a message indicating an error or an error code when an error occurs in the printer 100. The warning screen is used to warn the user in a state in which an error does not occur. The ready screen is displayed when print is accepted and is used to display the various menus. The speaker 53 outputs various warning sounds.

The controller 10 controls the printer 100. A configuration of the controller 10 will be described in detail with reference to FIG. 3.

Figure 3:
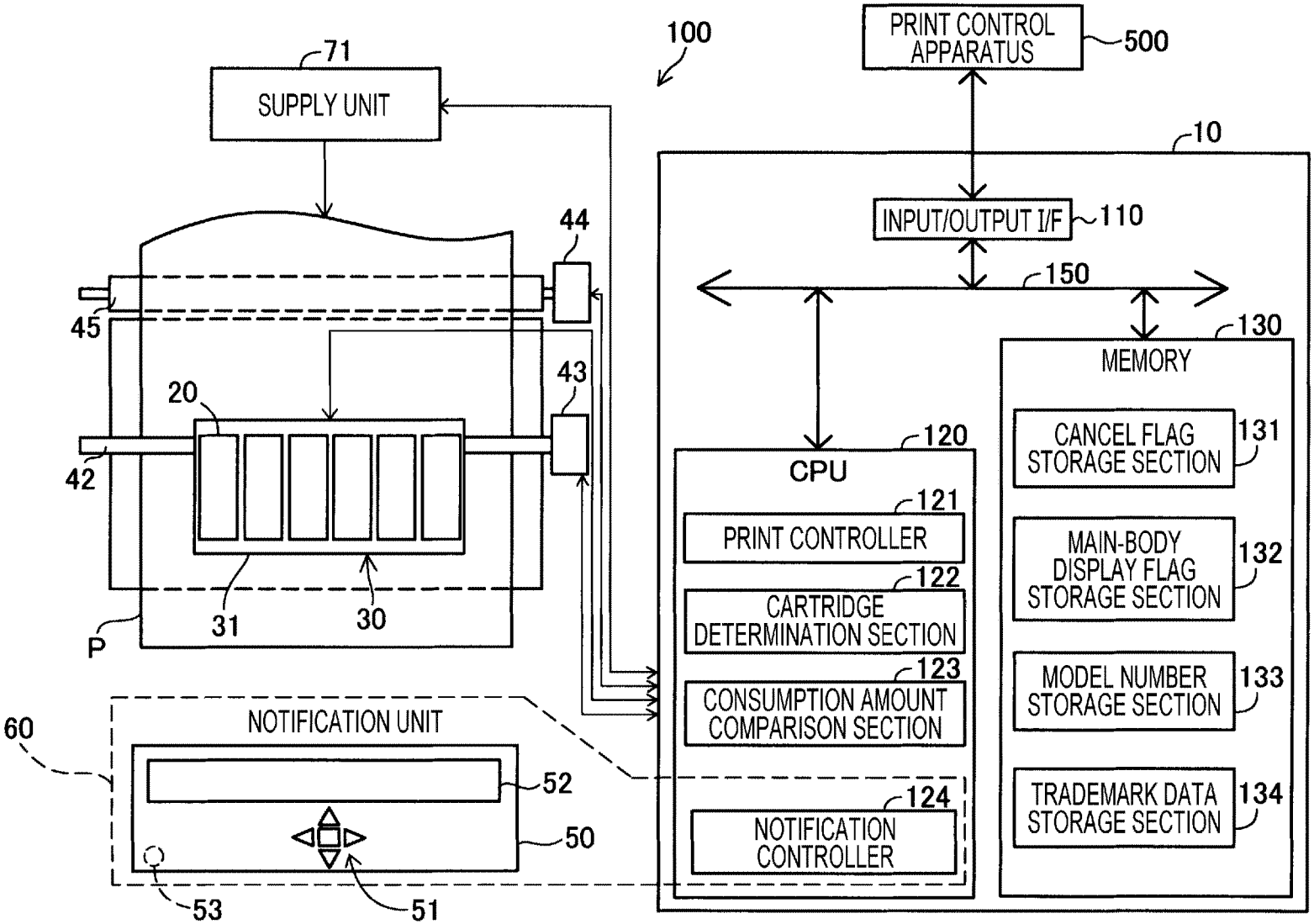
FIG. 3 is a block diagram illustrating a functional configuration of the printer.

FIG. 3 is a block diagram illustrating a functional configuration of the printer 100. As illustrated in FIG. 3, the controller 10 is constituted by a computer including an input/output interface 110, a central processing unit (CPU) 120, and a memory 130. The input/output interface 110 has an interface used to connect the print control apparatus 500 to the printer 100. Examples of the interface include a universal serial bus (USB) and a wireless local area network (LAN) interface.

The CPU 120 executes control programs stored in the memory 130 in advance so as to function as a print controller 121, a cartridge determination section 122, a consumption amount comparison section 123, and a notification controller 124.

The print controller 121 controls execution of printing based on print data supplied from the print control apparatus 500. Specifically, the print controller 121 controls a supply unit 71 so that the print medium P is supplied. The supply unit 71 includes a sheet tray, not illustrated, and supplies the print medium P accommodated in the sheet tray toward the disposed carriage 30. Furthermore, the print controller 121 controls the transport motor 44 so as to realize transport of the print medium P. Furthermore, the print controller 121 controls the carriage motor 43 so as to realize transport of the print medium P. Furthermore, the print controller 121 controls the individual cartridges 20 so as to realize ejection of ink droplets from the cartridges 20.

The cartridge determination section 122 determines whether the cartridges 20 installed in the holder 31 are a specified cartridge or an unspecified cartridge in a process for attaching a cartridge described below. The term "specified cartridge" indicates a cartridge having information for identifying a subject of a maintenance contract added thereto (hereinafter referred to as "maintenance subject information"). On the other hand, the term "unspecified cartridge" indicates a cartridge which does not have the maintenance subject information. The term "a subject of a maintenance contract" indicates that the printer 100 is a subject of a maintenance contract between a company which performs maintenance of the printer 100 (hereinafter referred to as a "maintenance company") and the user. In the maintenance contract between the maintenance company and the user, a following provision is made: When a specified cartridge is used by being attached to the printer 100, the printer 100 is the subject of the maintenance contract, whereas when an unspecified cartridge is used by being attached to the printer 100, the printer 100 is not the subject of the maintenance contract. Accordingly, addition of the maintenance subject information to the specified cartridge means that information indicating that "the printer 100 is the subject of the maintenance contract on the assumption that a specified cartridge is installed in the printer 100" is added to the cartridge 20. A method for adding the maintenance subject information will be described hereinafter. In this embodiment, the maintenance contract for the printer 100 having the specified cartridges installed therein is different from a contract associated with a general maintenance and is contract associated with a special maintenance. Specifically, unlike the general maintenance, the contract of the special maintenance includes a long-term free repair and the like. Cost for the special maintenance is allocated to the specified cartridge. Therefore, a unit sales price of the specified cartridge is higher than that of the unspecified cartridge. In other words, the cost for the special maintenance is allocated to the specified cartridge in advance, and therefore, the printer 100 having the specified cartridge attached thereto is a subject of the special maintenance, such as the long-term free repair, as an added value for the cost.

The consumption amount comparison section 123 executes comparison between ink consumption amounts of the cartridges 20 after replacement and a predetermined threshold amount in the process for attaching a cartridge described below.

The notification controller 124 controls a notification utilizing the operation section 50. Specifically, the notification controller 124 transmits content of an operation of the operation button 51 to the print controller 121 and the like. Furthermore, the notification controller 124 displays a menu screen and a message in the display section 52 for the user as a notification. In this embodiment, the operation section 50 and the notification controller 124 are collectively referred to as a notification section 60. The notification section 60 indicates that the maintenance contract is canceled or maintained for the user in the process for attaching a cartridge described below or prompts the user to replace the cartridge 20. Note that the term "cancellation of the maintenance contract" widely includes cancellation or rescission of the maintenance contract.

The memory 130 includes a nonvolatile memory which stores data which may be read and written by the CPU 120, such as an electrically erasable programmable read-only memory (EEPROM), and a memory which stores data which may be read and written by the CPU 120, such as a random access memory (RAM). The memory 130 includes a cancel flag storage section 131, a main-body display flag storage section 132, a model number storage section 133, and a trademark data storage section 134.

A cancel flag is stored in the cancel flag storage section 131. The cancel flag indicates cancellation of the maintenance contract. In this embodiment, a cancel flag of 1 indicates that the maintenance contract is canceled. On the other hand, when a cancel flag of 0 is set, the cancel flag is not stored, and therefore, the maintenance contract is not canceled. Specifically, when the cancel flag of 0 is set, the maintenance contract is maintained. Before the printer 100 is shipped, an initial value of 0 is set in the cancel flag. In other words, the cancel flag of 1 is not stored before shipping. This cancel flag may be changed to 1 in the process for attaching a cartridge described below.

The main-body display flag storage section 132 stores a main-body display flag. The main-body display flag indicates a determination as to whether display of a trademark associated with the maintenance contract (hereinafter referred to as a "maintenance associated trademark") in the display section 52 is to be permitted. In this embodiment, the maintenance associated trademark means a trademark indicating a service provided in accordance with the maintenance contract. The maintenance associated trademark is represented by a character string "AAA" for convenience sake in this embodiment. The character string "AAA" may be a character string "maintenance contract program", for example. However, the trademark is not limited to a character string and may be a logo or constituted by a character string, a sign, and the like. In this embodiment, the main-body display flag of 1 indicates that display of the trademark "AAA" associated with the maintenance contract in the display section 52 is permitted. On the other hand, the main-body display flag of 0 indicates that display of the trademark "AAA" associated with the maintenance contract in the display section 52 is not permitted. A value "1" or "0" is set as the main-body display flag under an agreement with the user in the contract. When a manufacturer of the printer 100 manufactures the printer 100 as original equipment manufacturing (OEM) of another company or when another company which has been commissioned by a manufacturer of the printer 100 to manufacture the printer 100 manufactures the printer 100 as a private brand printer of the other company separately from a printer which has been ordered, "0" may be set to the main-body display flag so that the trademark "AAA" is not displayed. Note that the maintenance associated trademark is not limited to a trademark indicating a service of the maintenance contract and may be an arbitrary trademark associated with the maintenance contract. For example, the maintenance associated trademark may be an arbitrary registered trademark of a maintenance company of the printer 100, that is, the manufacturer of the printer 100 in this embodiment. Examples of such a registered trademark include a registered trademark which indicates the printer 100 as designated goods or a registered trademark which indicates maintenance of the printer 100 as a designated service.

The model number storage section 133 stores a model number of a cartridge which is compatible with the printer 100 in advance. The model number of the cartridge will be described hereinafter in detail.

The trademark data storage section 134 stores data on the maintenance associated trademark, that is, data on the character string AAA in this embodiment. Specifically, in this embodiment, the trademark data storage section 134 stores firmware which is a control program, and data on the character string AAA is described in the firmware.

Figure 4:
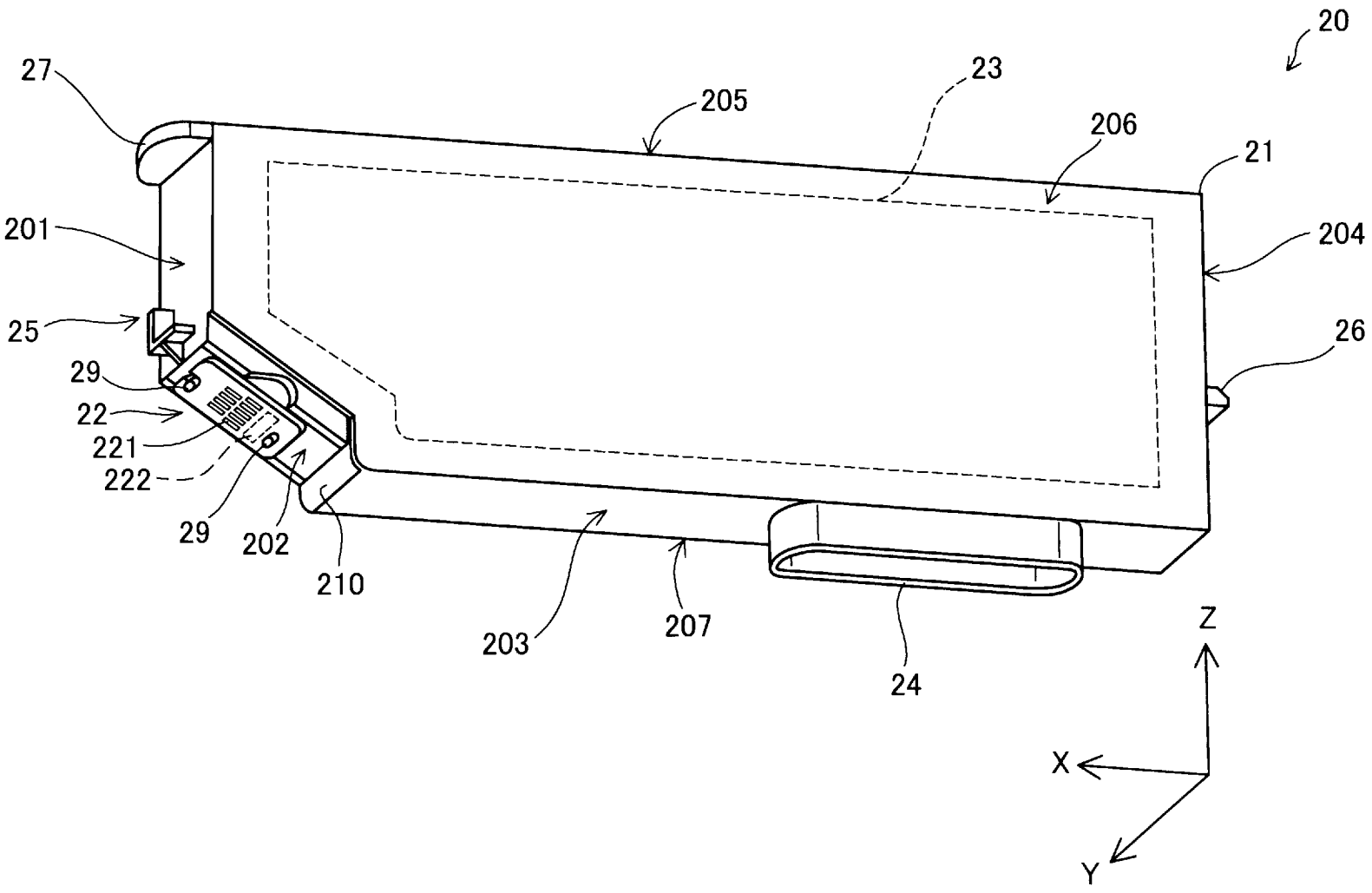
FIG. 4 is a perspective view of appearance of a cartridge.

FIG. 4 is a perspective view of an appearance of one of the cartridges 20. The cartridge 20 is a half-sealing type ink cartridge which intermittently guides outer air to a liquid accommodation section 23 in accordance with consumption of ink.

The cartridge 20 has a substantially cubic shape as appearance. The cartridge 20 includes an outer shell 21, the circuit substrate 22, the liquid accommodation section 23, the liquid supply sections 24, a first engagement section 25, a second engagement section 26, and an operation projection 27.

The outer shell 21 has seven plane exposed outside, that is, a first plane 201, a second plane 202, a third plane 203, a fourth plane 204, a fifth plane 205, a sixth plane 206, and a seventh plane 207. The first plane 201 and the fourth plane 204 are opposed to each other. The third plane 203 and the fifth plane 205 are opposed to each other. The sixth plane 206 and the seventh plane 207 are opposed to each other. The second plane 202 is sandwiched between the first plane 201 and the third plane 203. The second plane 202 is inclined relative to the first plane 201 and the third plane 203. An outer edge of the first plane 201 and an outer edge of the second plane 202 are in contact with each other. On the other hand, the outer edge of the second plane 202 and the outer edge of the third plane 203 are coupled to each other through a step 210 which is substantially parallel to the X axis. A pair of boss sections 29 for fixing the circuit substrate 22 is formed on the second plane 202. The outer shell 21 is formed of a synthetic resin, such as polypropylene (PP). Note that a portion of the outer shell 21, such as a portion of the sixth plane 206, may be formed of a resin film.

The circuit substrate 22 is disposed on the second plane 202. The circuit substrate 22 has an appearance shape of a thin plate. A boss hole and a boss groove into which the boss sections 29 are inserted are formed on the circuit substrate 22. The circuit substrate 22 is fixed on the second plane 202 when the pair of boss sections 29 is accommodated in the boss hole and the boss groove. A plurality of terminals 221 are disposed on a surface of the circuit substrate 22, that is, a plane which is exposed outside of the circuit substrate 22. Furthermore, a storage device 222 is disposed on a back surface of the circuit substrate 22. The storage device 222 is constituted by a nonvolatile memory, such as an EEPROM, which stores data such that the controller 10 may read and write the data in this embodiment. A number of the terminals 221 are electrically coupled to the storage device 222. The terminals 221 are in contact with the electrode sections 322 of the carriage 30 when the cartridge 20 is attached to the carriage 30. By this, the storage device 222 and the controller 10 are electrically coupled to each other, the controller 10 may read data written in the storage device 222, and the controller 10 may rewrite data written in the storage device 222. Furthermore, a number of the terminals 221 are used when the controller 10 executes detection of attachment of the cartridge 20 to the holder 31 (hereinafter referred to as "attachment detection").

Figure 5:
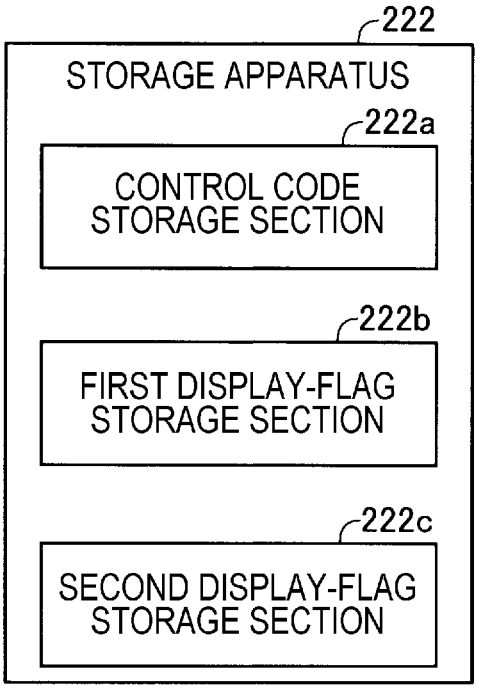
FIG. 5 is a block diagram schematically illustrating a configuration of a storage device.

FIG. 5 is a block diagram schematically illustrating a configuration of the storage device 222. The storage device 222 includes a control code storage section 222*a*, a first display-flag storage section 222*b*, and a second display-flag storage section 222*c*.

The control code storage section 222*a* stores a control code. The controller 10 refers to the control code when controlling printing. The control code includes a code indicating a manufacturer of the cartridge 20 and a code indicating a model number of the cartridge 20. The code indicating a model number includes an identifier for distinguishing a cartridge 20 to be used when the maintenance contract has been made from a cartridge 20 to be used when the maintenance contract has been not made and includes a code indicating a type of ink accommodated in the cartridge 20.

The "cartridge 20 to be used when the maintenance contract has been made" has a unit selling price which is higher than the cartridge 20 to be used when the maintenance contract has not been made as described above. This is because a portion of maintenance cost is included in a unit price of the cartridge 20. The identifier indicating the cartridge 20 to be used when the maintenance contract has been made corresponds to the "maintenance subject information" described above. Specifically, storage of the code indicating a model number which is an identifier of a cartridge to be used when the maintenance contract has been made in the control code storage section 222*a* means attachment of the maintenance subject information in this embodiment.

The code indicating a type of ink described above corresponds to a code indicating a water-based ink or solvent ink, a code indicating an ink color, or the like. The control code is stored in advance by the manufacturer of the cartridge 20 before shipping of the cartridge 20.

The first display-flag storage section 222*b* stores a first display flag. The first display flag indicates a predetermined message using the maintenance associated trademark, and means a flag used to determine whether display of a message which is a predetermined message using the maintenance associated trademark and which highly likely causes a problem about maintenance cost when the message is displayed for the user in the display section 52 is to be permitted. Examples of the message include a message "The trademark AAA is maintained", for example. When the message described above is displayed although an unspecified cartridge is installed in the printer 100, the maintenance contract for providing a service indicated by the trademark AAA is actually canceled, and therefore, a problem may arise about the maintenance cost due to the display of the message. In this embodiment, the first display flag of 1 indicates that the display of the message which highly likely causes a problem about the maintenance cost is permitted. On the other hand, the first display flag of 0 indicates that the display of the message which highly likely causes a problem about the maintenance cost is not permitted. Before the cartridge 20 is shipped from the manufacturer, "1" or "0" is set to the first display flag. Specifically, "1" is set to the first display flag for the cartridge 20 to be used when the maintenance contract has been made and "0" is set to the first display flag for the cartridge 20 to be used when the maintenance contract has not been made.

The second display-flag storage section 222*c* stores a second display flag. The second display flag indicates a predetermined message using the maintenance associated trademark, and means a flag used to determine whether display of a message for avoiding a problem about maintenance cost by replacement of a cartridge when the message is displayed in the display section 52 is to be permitted. Examples of the message include a message "The trademark AAA may be canceled", for example. When the unspecified cartridge is installed in the printer 100, it is highly possible that a problem about the maintenance cost is avoided by replacement of a cartridge when such a message is displayed. In this embodiment, the second display flag of 1 indicates that the display of the message for avoiding a problem about the maintenance cost by replacement of a cartridge is permitted. On the other hand, the second display flag of 0 indicates that the display of the message for avoiding a problem about the maintenance cost by replacement of a cartridge is not permitted. Before the cartridge 20 is shipped from the manufacturer, "1" is set to the second display flag.

Here, the model number included in the control code described above may be stored as plain text as information indicating the model number as it is. Furthermore, the model number may be encrypted to prevent falsification. When the model number is to be encrypted, at least one of the first and second display flags described above may be used as a portion of an encryption key or a decryption key. Note that the control code storage section 222*a* is preferably constituted by a non-writable region of the storage device 222, and the first display-flag storage section 222*b* and the second display-flag storage section 222*c* are preferably constituted by writable regions of the storage device 222. With this configuration, even a company in which manufacture of the storage device 222 is technically difficult may freely set the first display-flag storage section 222*b* and the second display-flag storage section 222*c*. By this, free communication between a company which supplies the cartridge 20 and a consumer of the cartridge 20 is not disturbed.

The liquid accommodation section 23 of FIG. 4 is configured as a chamber which accommodates ink and which is formed inside the outer shell 21. The liquid accommodation section 23 is coupled to the liquid supply section 24 through an ink path, not illustrated, formed inside the outer shell 21. The liquid supply section 24 has a tubular appearance shape and projects from the third plane 203 in the −Z direction. A corresponding one of the ink intake sections 325 of the holder 31 is inserted into the liquid supply sections 24 in the attached state. The liquid supply section 24 supplies the ink accommodated in the liquid accommodation section 23 to the ink intake section 325 in the attached state.

The first engagement section 25 and the second engagement section 26 are engaged with the holder main body section 301 when the cartridge 20 is attached to the holder 31. The first engagement section 25 is disposed in the vicinity of a boundary between the first plane 201 and the second plane 202 on the first plane 201, and is engaged with a corresponding one of the holder engagement sections 327 disposed in the slots SL1 to SL6 of the holder 31 in the attached state. The second engagement section 26 is disposed on the fourth plane 204 and is inserted into an engagement hole disposed in the holder main body section 301 for a corresponding one of the slots SL1 to SL6 in the attached state. By this, positioning is performed when the cartridges 20 are attached to the slots SL1 to SL6. The user applies pressure to the operation projection 27 when the cartridge 20 is attached to the holder 31 or detached from the holder 31. The operation projection 27 is disposed at an end of the first plane 201 in the +Z direction and projects in the +X direction.

A cartridge (referred to as a "similar cartridge" for convenience sake) having the same configuration as the cartridge 20 having the configuration described above is manufactured by a company different from the manufacturer of the cartridge 20 in some cases. In this embodiment, the manufacturer of the cartridge 20 is the same as a manufacturer of the printer 100. In general, ink filled in the similar cartridge has components and quality which are different from those of the ink of the manufacturer of the cartridge 20, and therefore, if the similar cartridge is attached to the printer 100 and used, nozzle clogging and ink ejection failure may occur, or furthermore, failure of the carriage 30 may occur according to circumstances. Therefore, if the similar cartridge is attached and used in the printer 100, the maintenance company may not maintain the printer 100. Here, as with the cartridge 20, the similar cartridge has a circuit substrate, and flags stored in the cartridge 20, that is, first and second display flags, are set in the storage device of the circuit substrate. When the similar cartridge is used in the printer 100, the maintenance contract is canceled. Therefore, when "1" is set as the first display flag in the similar cartridge, a message "The trademark AAA is maintained" is displayed in the display section 52 and it is highly possible that a problem associated with maintenance cost arises. Accordingly, the other company described above sets "0" to the first display flag. Furthermore, in general, "1" is set toe the second display flag so that a problem associated with the maintenance cost is avoided by replacing cartridges. However, when a manufacturer of the similar cartridge does not prompt avoidance of cartridge replacement by a message, "0" may be set to the second display flag. Furthermore, when the similar cartridge is manufactured by reusing a cartridge manufactured by the manufacturer of the cartridge 20, "1" may have been set in the second display flag. A model number included in a control code in the similar cartridge may be the same as the model number set in the specified cartridge, that is, the cartridge 20 to be used when the maintenance contract has been made.

Furthermore, also when the cartridge 20 to be used when the maintenance contract has not been made is attached to the printer 100 among cartridges 20 manufactured by the manufacturer of the cartridges 20, the maintenance company may not maintain the printer 100. In the case where such a cartridge 20 is used, "0" is set to the first flag and "1" is set to the second flag.

On the other hand, as described above, "1" is set to the first and second display flags of the cartridge 20 used when the maintenance contract has been made among the cartridges 20 manufactured by the manufacturer of the cartridges 20 before shipping. Therefore, if such a cartridge 20 is attached and used in the printer 100, the maintenance company may maintain the printer 100.

In the printer 100 having the configuration described above, when the process for attaching a cartridge described below is executed, if a failure occurs due to past usage of an unspecified cartridge, the misunderstanding of the user that services defined by the maintenance contract may be still available since the specified cartridge is currently used although the maintenance contract has been canceled due to the use of the unspecified cartridge in the past may be suppressed.

A2. Process for Attaching Cartridge

Figure 6:
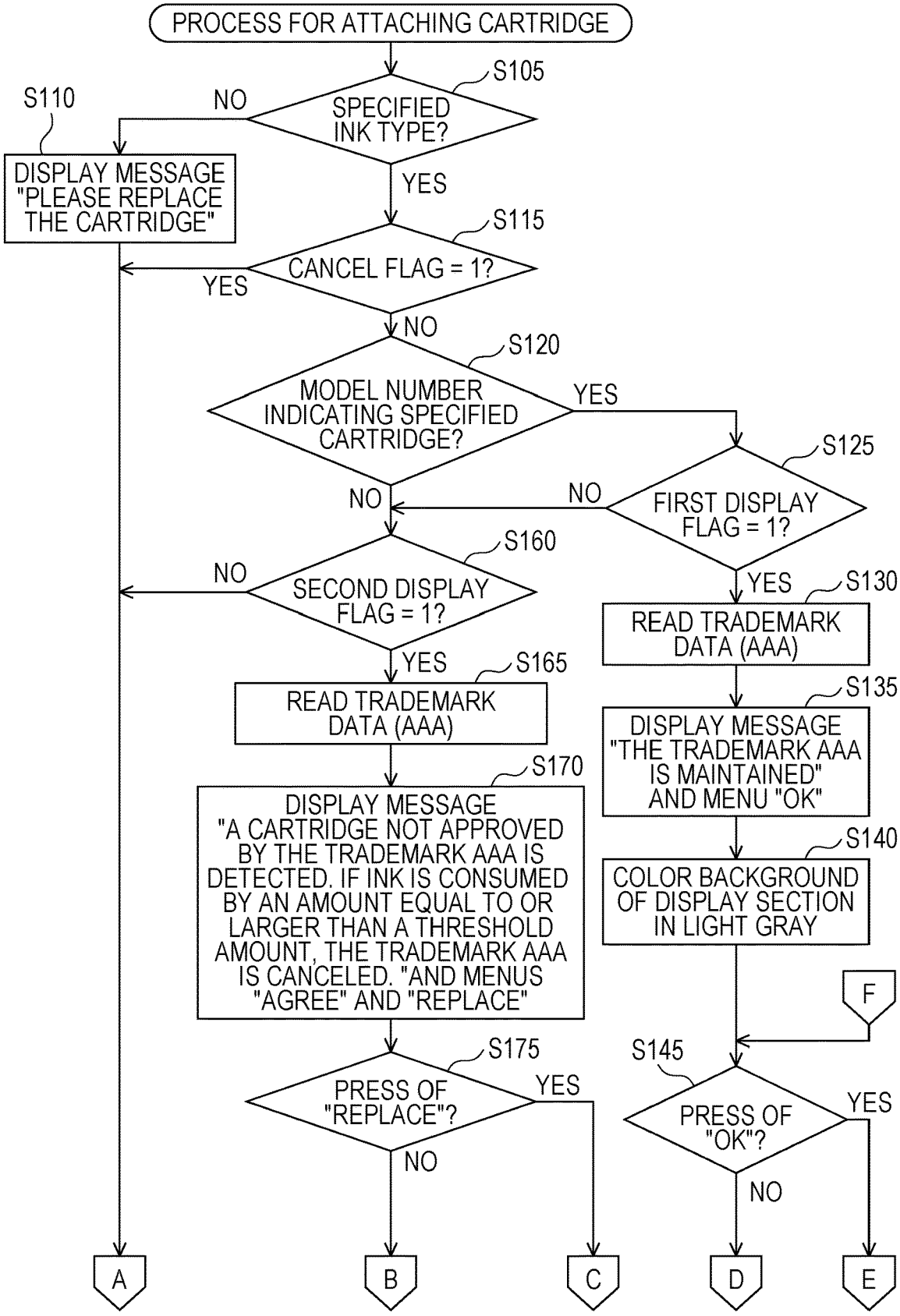
FIG. 6 is a flowchart of a procedure of a process for attaching the cartridge according to this embodiment.
Figure 7:
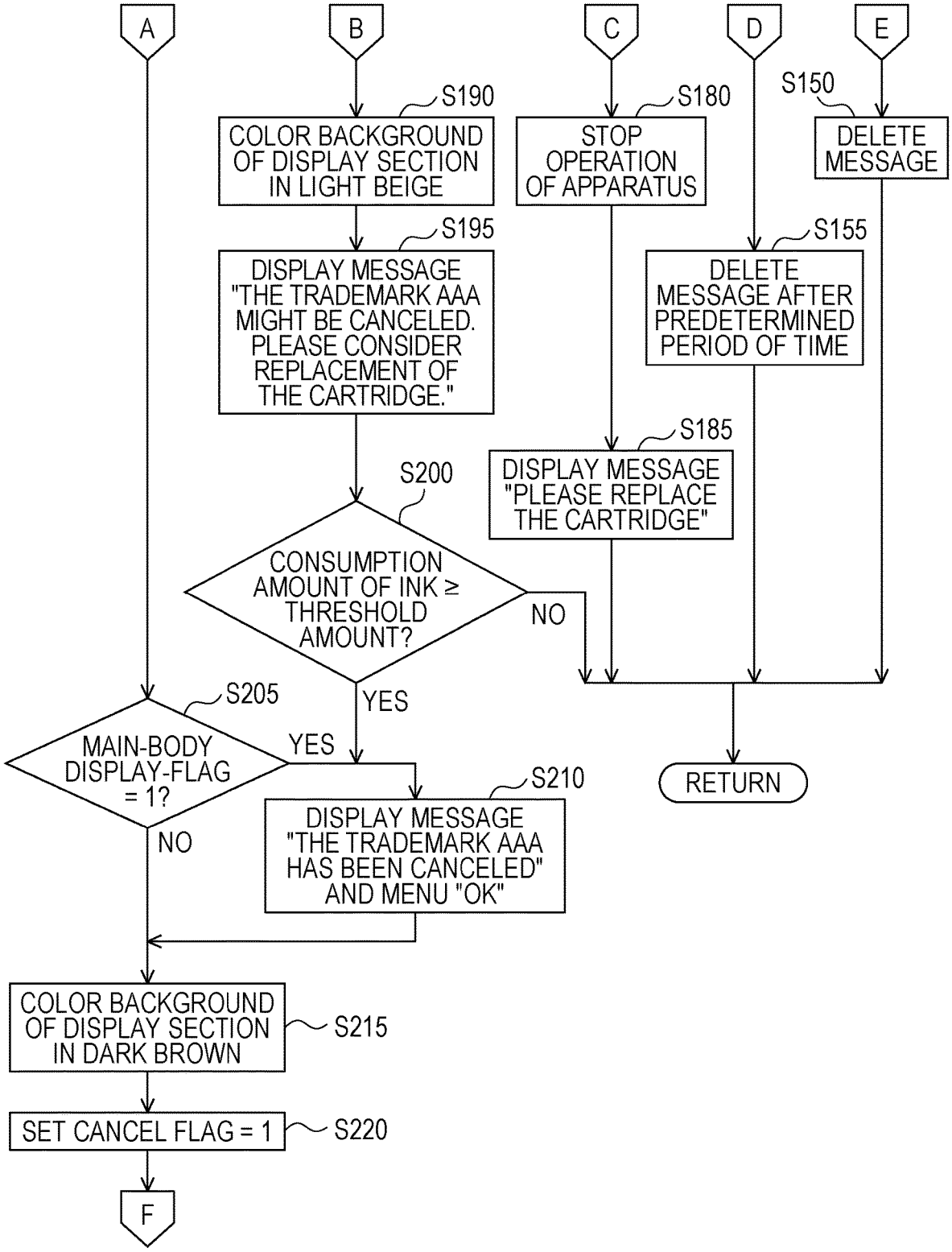
FIG. 7 is the flowchart of the procedure of the process for attaching the cartridge according to this embodiment.

FIGS. 6 and 7 are a flowchart of a procedure of the process for attaching a cartridge according to this embodiment. In the process for attaching a cartridge, a process to be executed by the printer 100 is determined when a cartridge is newly attached to the printer 100, and the determined process is performed. When the printer 100 is powered, the controller 10 executes attachment detection. Thereafter, when new attachment of a cartridge to the holder 31 is detected, the process for attaching a cartridge is executed. Note that, as the cartridge newly attached to the printer 100, both the specified cartridge and the unspecified cartridge described above are assumed. Hereinafter, components of the unspecified cartridge which are the same as those of the cartridge 20 are denoted by reference numerals which are the same as those of the cartridge 20.

The cartridge determination section 122 determines whether a type of ink filled in the cartridge which is newly attached is a type which is designated in advance (step S105). Specifically, the cartridge determination section 122 reads the control code from the storage device 222 of the newly-attached cartridge and determines whether a type of filled ink is a type which is designated in advance based on a code indicating a type of ink included in the control code (step S105). When the determination is negative (step S105: NO), the notification section 60 displays a message "Please replace the cartridge" in the display section 52 to prompt replacement of the cartridge (step S110).

When the determination is affirmative in step S105 described above (step S105: YES), the cartridge determination section 122 determines whether "1" has been set to the cancel flag (step S115). When the determination is negative (step S115: NO), that is, when it is determined that the maintenance contract has not been canceled, the cartridge determination section 122 determines whether a model number stored in the newly-attached cartridge indicates the specified cartridge (step S120). Specifically, the cartridge determination section 122 reads the control code from the storage device 222 of the newly-attached cartridge and determines whether a model number of the cartridge included in the control code indicates the specified cartridge. Note that, as described above, even if the model number indicates the specified cartridge, the newly-attached cartridge may be a similar cartridge.

When the determination is affirmative (step S120: YES), the cartridge determination section 122 reads the first display flag from the storage device 222 and determines whether "1" has been set in the first display flag (step S125). When the determination is affirmative (step S125: YES), the notification section 60 reads trademark data from the trademark data storage section 134 (step S130). In this embodiment, data on the character string AAA is read from the trademark data storage section 134. Note that the first display-flag storage section 222*b* may store "1" or "0" as the first display flag. Therefore, when no data is stored as a result of checking of values stored in the first display-flag storage section 222*b* in step S125 described above, that is, when the first display-flag storage section 222*b* does not exist, the process for attaching a cartridge may be stopped as a read/write error or the operation of the printer 100 may be stopped.

The notification section 60 displays a message "The trademark AAA is maintained" and a menu button "OK" in the display section 52 (step S135). If the model number of the newly-attached cartridge is the same as the model number of the specified cartridge and "1" is set to the first display flag, it is highly probable that the newly-attached cartridge is to be used when the maintenance contract has been made. Accordingly, in this case, the maintenance contract indicated by the trademark AAA is not to be canceled but is to be maintained. Therefore, in step S135, the message indicating that the maintenance contract is maintained is displayed in the display section 52. After the process in step S135 is executed, the notification section 60 colors a background of the display section 52 in light gray (step S140). The background is colored in the light gray so that the message becomes noticeable and a comparatively low importance degree of the message is indicated. Note that, when the ready screen is displayed after step S140, a display color of at least a portion of the ready screen may be differentiated between two states, that is, a state in which the maintenance contract is maintained and a state in which the maintenance contract is canceled so that one of the two states is clearly realized. In this way, even when a predetermined message is no longer displayed in the display section 52, the user may easily recognize a state of the maintenance contract by viewing the display color of at least the portion of the ready screen.

The notification section 60 determines whether the menu button "OK" has been pressed within a predetermined period of time (step S145). When the determination is affirmative (step S145: YES), the notification section 60 deletes the message displayed in step S135 as illustrated in FIG. 7 (step S150). On the other hand, when the determination is negative (step S145: NO), the notification section 60 deletes the message displayed in step S135 after a predetermined period of time has further elapsed (step S155). In this embodiment, the predetermined period of time in step S155 is one minute. Note that an arbitrary period of time may be set instead of one minute.

When the determination is negative in step S120 described above (step S120: NO) or when the determination is negative in step S125 described above (step S125: NO), the cartridge determination section 122 reads the second display flag from the storage device 222 and determines whether "1" has been set in the second display flag (step S160). It is assumed that the process in step S160 is executed, when the newly-attached cartridge is the similar cartridge described above or the cartridge 20 to be used when the maintenance contract has not been made. Note that the second display-flag storage section 222*c* may store "1" or "0" as the second display flag. Therefore, when no data is stored as a result of checking of values stored in the second display-flag storage section 222*c* in step S160 described above, that is, when the second display-flag storage section 222*c* does not exist, the process for attaching a cartridge may be stopped as a read/write error or the operation of the printer 100 may be stopped.

When the determination is affirmative (step S160: YES), the notification section 60 reads the trademark data from the trademark data storage section 134 (step S165). Step S165 is the same as step S130 described above, and therefore, a detailed description of step S165 is omitted.

The notification section 60 displays a message suggesting cancellation of the maintenance contract in the display section 52. Specifically, the notification section 60 displays a message "A cartridge not approved by the trademark AAA is detected. If ink is consumed by an amount equal to or larger than a threshold amount, the trademark AAA is canceled" and menu buttons "Agree" and "Replace" in the display section 52 (step S170). Since the message is displayed in the display section 52, the user may recognize that the maintenance contract of the trademark AAA is canceled when the newly-attached cartridge is consumed by an amount equal to or larger than a predetermined threshold amount. Furthermore, when the user does not have a spare of the specified cartridge but has only the unspecified cartridge for some reasons, printing may be performed using the unspecified cartridge for a while as an emergency action. Furthermore, the user is prevented from casually continuing printing since the user recognizes that a maintenance state is an emergency action state at least in a user interface of the operation section 50 which is waiting for print information, that is, the ready screen. In this embodiment, the predetermined threshold amount in step S170 is 100 ml. Note that an arbitrary amount may be set instead of 100 ml.

The menu button "Agree" is used to express a user's intention that the cancellation of the trademark AAA is permitted. On the other hand, the menu button "Replace" is used to express a user's intention that the newly-attached cartridge is not used but is detached and replaced by a specified cartridge. Accordingly, the user may select "Agree" or "Replace" after understanding that the maintenance contract of the trademark AAA is canceled when the newly-attached cartridge is used.

The notification section 60 determines whether the menu button "Replace" has been selected (step S175). When the determination is affirmative (step S175: YES), the print controller 121 stops the operation of the printer 100 other than a process of determining attachment of a new cartridge and operations of the cartridge determination section 122 and the notification section 60 associated with the process for attaching a cartridge as illustrated in FIG. 7 (step S180). The notification section 60 displays a message "Please replace the cartridge" in the display section 52 (step S185).

When the menu button "Replace" has not been selected, that is, when it is determined that the menu button "Agree" has been selected (step S175: NO), the notification section 60 colors the background of the display section 52 in light beige (step S190). The background is colored in the light beige so that the message becomes noticeable and a comparatively high importance degree of the message is indicated. The notification section 60 displays a message indicating replacement by a specified cartridge in addition to a suggestion of the cancellation of the maintenance contract in the display section 52. Specifically, the notification section 60 displays a message "The trademark AAA might be canceled. Please consider replacement of the cartridge" in the display section 52 (step S195).

After the message "Please replace the cartridge" is displayed in the display section 52 in step S110 described above, the cartridge determination section 122 reads the main-body display flag from the memory 130 and determines whether "1" has been set in the main-body display flag (step S205). When the determination is affirmative (step S205: YES), that is, when display of the trademark AAA which is a maintenance associated trademark in the display section 52 is permitted, the notification section 60 displays a message "The trademark AAA has been canceled" and the menu button "OK" in the display section 52 (step S210). On the other hand, when the determination is negative (step S205: NO), the notification section 60 colors the background of the display section 52 in dark brown (step S215). The background is colored in the dark brown so that the message becomes noticeable and the highest importance degree of the message is indicated. Note that, when the ready screen is to be displayed after step S215, a display color of at least a portion of the ready screen may be differentiated between two states, that is, a state in which the maintenance contract is maintained and a state in which the maintenance contract is canceled so that one of the two states is clearly realized. In this way, even when a predetermined message is no longer displayed in the display section 52, the user may easily recognize a state of the maintenance contract by viewing the display color of at least the portion of the ready screen. After the execution of step S215, the cartridge determination section 122 sets "1" to the cancel flag stored in the memory 130 (step S220). In other words, the cartridge determination section 122 causes the memory 130 to store the cancel flag. In this case, the cancel flag indicates the cancellation of the maintenance contract. Note that, after the process in step S210 described above is executed, processes in step S215 and step S220 described above are executed. After execution of the process in step S220, the process in step S145 is executed as described above as illustrated in FIG. 6.

After step S195 described above, the consumption amount comparison section 123 executes comparison between an amount of consumption of ink after the selection of "Agree" and a predetermined threshold amount so as to determine whether the ink consumption amount is equal to or larger than the predetermined threshold amount (step S200). When the determination is affirmative (step S200: YES), a process in step S210 described above is executed. Accordingly, in this case, a message "The trademark AAA has been canceled" is displayed in the display section 52. Since the message is displayed in the display section 52, the user may recognize that the maintenance contract has been canceled since the unspecified cartridge is consumed by an amount equal to or larger than the predetermined threshold amount.

When the determination is negative in step S200 (step S200: NO), the process returns to step S105 described above. Similarly, also after processes in step S150, step S155, and step S185 described above are executed, the process returns to step S105 described above. Instead of the process returning to step S105, the process for attaching a cartridge may be terminated. In this case, when a cartridge newly attached to the holder 31 is detected again, the process for attaching a cartridge is executed again.

For example, when the user detaches the specified cartridge from the printer 100 and the similar cartridge having the first display flag and the second display flag of "0" is attached to the printer 100 for the first time, a process in step S220 is executed so that the cancel flag of 0 is changed to the cancel flag of 1. Accordingly, after this operation, even if the similar cartridge is replaced by a specified cartridge, it is determined that "1" has been set in the cancel flag in step S115 since "1" has been set in the cancel flag. Therefore, the process from step S205 to step S220 is executed and the cancel flag of 1 is maintained.

Furthermore, when the user detaches the specified cartridge from the printer 100 and the similar cartridge having the first display flag of 0 and the second display flag of 1 or the cartridge 20 to be used when the maintenance contract has not been made is attached to the printer 100 for the first time, for example, the process in step S170 is executed and the message "A cartridge not approved by the trademark AAA is detected. If ink is consumed by an amount equal to or larger than a predetermined threshold amount, the trademark AAA is canceled" and the menu buttons "Agree" and "Replace" are displayed in the display section 52. Thereafter, if the user selects the menu button "Replace", and thereafter, replacement by a specified cartridge is performed before the ink is consumed by an amount equal to or larger than the threshold amount, the process in step S220 is not executed. Therefore, the cancel flag of 0 is maintained and the maintenance contract is maintained. On the other hand, if the ink is consumed by an amount equal to or larger than the threshold amount after the user selects the menu button "Agree", the process in step S220 is executed so that the cancel flag of 0 is changed to the cancel flag of 1. Accordingly, even if the similar cartridge is replaced by a specified cartridge after this operation, it is determined that "1" has been set in the cancel flag in step S115 since "1" has been set in the cancel flag. Accordingly, the process from step S205 to step S220 is executed and only if "1" has been set in the main-body display flag, the message "The trademark AAA has been canceled" is displayed and the cancel flag of 1 is maintained.

When being requested by the user to perform repair of the printer 100 due to some failure, the maintenance company identified a setting value of the cancel flag stored in the memory 130. In the case of the cancel flag of 1, the maintenance contract has been canceled, and therefore, it is determined that services based on the maintenance contract, that is, free repair, are not available. Furthermore, in the case of the cancel flag of 0, the maintenance contract is maintained, and therefore, it is determined that services based on the maintenance contract are available. Accordingly, when the user attaches the similar cartridge having the first and second display flags of 0 or when the similar cartridge having the first display flag of 0 and the second display flag of 1 or the cartridge 20 to be used when the maintenance contract has not been made is attached to the printer 100 and ink is consumed by an amount equal to or larger than the threshold amount, the maintenance company recognizes that the maintenance contract has been canceled, that is, the printer 100 is not a subject of the maintenance even if a specified cartridge is newly attached and consumed.

On the other hand, in a case where the similar cartridge having the first and second display flags of 0 is newly attached, when the main-body display flag of 1 has been set, the message "The trademark AAA has been canceled" is displayed in the display section 52, and therefore, the user may recognize that the maintenance contract has been canceled due to the newly-attached cartridge. Furthermore, when the similar cartridge having the first display flag of 0 and the second display flag of 1 or the cartridge 20 to be used when the maintenance contract has not been made is attached to the printer 100, the message "A cartridge not approved by the trademark AAA is detected. If ink is consumed by an amount equal to or larger than a predetermined threshold amount, the trademark AAA is canceled" is displayed in the display section 52, and therefore, the user may recognize that the maintenance contract is canceled if the newly-attached cartridge is continuously used and ink is consumed by an amount equal to or larger than the threshold amount. Furthermore, in a case where the ink is consumed by an amount equal to or larger than the threshold mount in practice, when the main-body display flag of 1 has been set, a message "The trademark AAA has been canceled" is displayed in the display section 52, and therefore, the user may recognize that the maintenance contract has been canceled due to the consumption of the ink of the newly-attached cartridge. Furthermore, when the maintenance contract is canceled in this way, the process in step S220 is executed so that the cancel flag of 1 is set, and the cancel flag of 1 is not changed to the cancel flag of 0. Therefore, even if the user attaches a specified cartridge to the printer 100 after the set of the cancel flag of 1, the message "The trademark AAA has been canceled" is displayed in the display section 52 when the main-body display flag of 1 is set. Therefore, the user may recognize that the maintenance contract has been canceled and misunderstanding of the user that the maintenance contract has been maintained may be suppressed.

According to the printer 100 of this embodiment described above, in a case where the cartridge determination section 122 determines that an unspecified cartridge has been detected, that is, in a case where the determination is negative in step S120, when the second display flag of 1 is set, a selection of use agreement of the unspecified cartridge or replacement of the unspecified cartridge by a specified cartridge is requested. The selection of the use agreement indicates cancellation of the maintenance contract and a message prompting the replacement by a specified cartridge is displayed in the display section 52. Accordingly, when the user selects the use agreement to use the unspecified cartridge, a notification indicating that the maintenance contract is canceling is displayed and suppression of the cancellation of the maintenance contract may be realized by suggesting the replacement by a specified cartridge. Accordingly, the misunderstanding of the user that services defined by the maintenance contract may be still available if a failure occurs in the printer 100 although the maintenance contract has been canceled due to the use of the unspecified cartridge in the past may be suppressed.

Furthermore, the notification section 60 displays the message "The trademark AAA has been canceled" indicating a confirmation of the cancellation of the maintenance contract when a result of the comparison performed by the consumption amount comparison section 123, that is, a result of the comparison between an ink consumption amount and a predetermined threshold amount after "Agree" is selected indicates that the ink consumption amount is equal to or larger than the threshold amount. In this way, the user may realize that the maintenance contract has been canceled.

Furthermore, when a result of the comparison performed by the consumption amount comparison section 123 indicates that the ink consumption amount is equal to or larger than the threshold amount, the cancel flag of 1 indicating the cancellation of the maintenance contract is stored. Therefore, even when a specified cartridge is attached to the printer 100 after that, the fact that the maintenance contract has been canceled may be specified by the cancel flag.

Furthermore, since the message "The trademark AAA has been canceled" is displayed in the display section 52 in the case where an unspecified cartridge is attached, ink accommodated in the unspecified cartridge is consumed by an amount equal to or larger than the threshold amount, and thereafter, the unspecified cartridge is replaced by a specified cartridge, information indicating that the maintenance contract has been canceled may be displayed for the user. Accordingly, the misunderstanding of the user that services defined by the maintenance contract may be still available if a failure occurs in the consumables consumption apparatus although the maintenance contract has been cancelled due to the use of the unspecified cartridge in the past may be more reliably suppressed.

Furthermore, when the cartridge determination section 122 determines that a cartridge newly attached to the printer 100 is a specified cartridge, the user may recognize that the maintenance contract is maintained by a notification indicating that the maintenance contract is maintained.

Furthermore, when the cartridge determination section 122 determines that a cartridge newly attached to the printer 100 is a specified cartridge in a state of the cancel flag of 0, the user may recognize that the maintenance contract is maintained by a notification indicating that the maintenance contract is maintained only when the first display flag of 1 is set.

Furthermore, in a case where, after the message "Please replace the cartridge" prompting replacement is displayed in the display section 52 in step S185, the replacement by a specified cartridge is actually performed by selecting the menu button "Replace", only when the first display flag of 1 is set, the process in step S135 is executed so that the message "The trademark AAA is maintained" is displayed in the display section 52. Accordingly, the user may recognize that the maintenance contract is maintained.

Furthermore, when the message indicating that the maintenance contract has been canceled or the message indicating that the maintenance contract is maintained is displayed, the trademark AAA is also displayed, and therefore, the user may recognize reliability of the display of the message.

Furthermore, the notification section 60 includes the display section 52 and causes the display section 52 to display various messages, and therefore, the notification section 60 may clearly perform a notification indicating that the maintenance contract has been canceled or the maintenance contract is maintained when the user is positioned near the printer 100.

B. Second Embodiment

Figure 8:
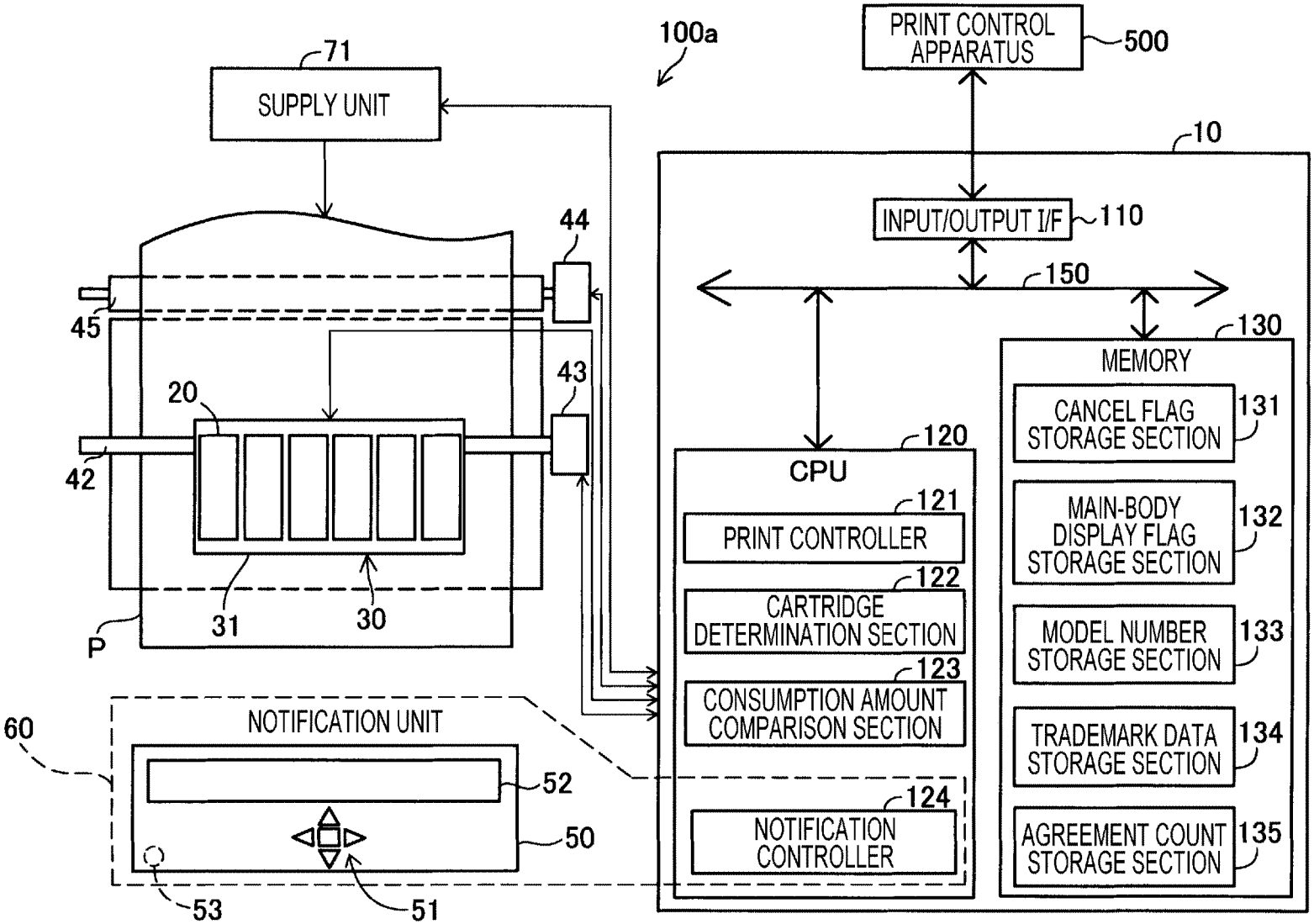
FIG. 8 is a block diagram illustrating a functional configuration of a printer according to a second embodiment.

FIG. 8 is a block diagram illustrating a functional configuration of a printer 100*a* according to a second embodiment. The printer 100*a* of the second embodiment is different from the printer 100 of the first embodiment in that a memory 130 includes an agreement count storage section 135. Other components included in the printer 100*a* of the second embodiment are the same as those of the printer 100 of the first embodiment, and therefore, same reference numerals are assigned to the same components and detailed descriptions of the same components are omitted.

The agreement count storage section 135 stores the number of times a user has selected a menu button "Agree" (hereinafter referred to as an "agreement count"), that is, the number of times an unspecified cartridge is intentionally attached. Before shipping of the printer 100*a*, the agreement count storage section 135 stores an initial value 0.

Figure 9:
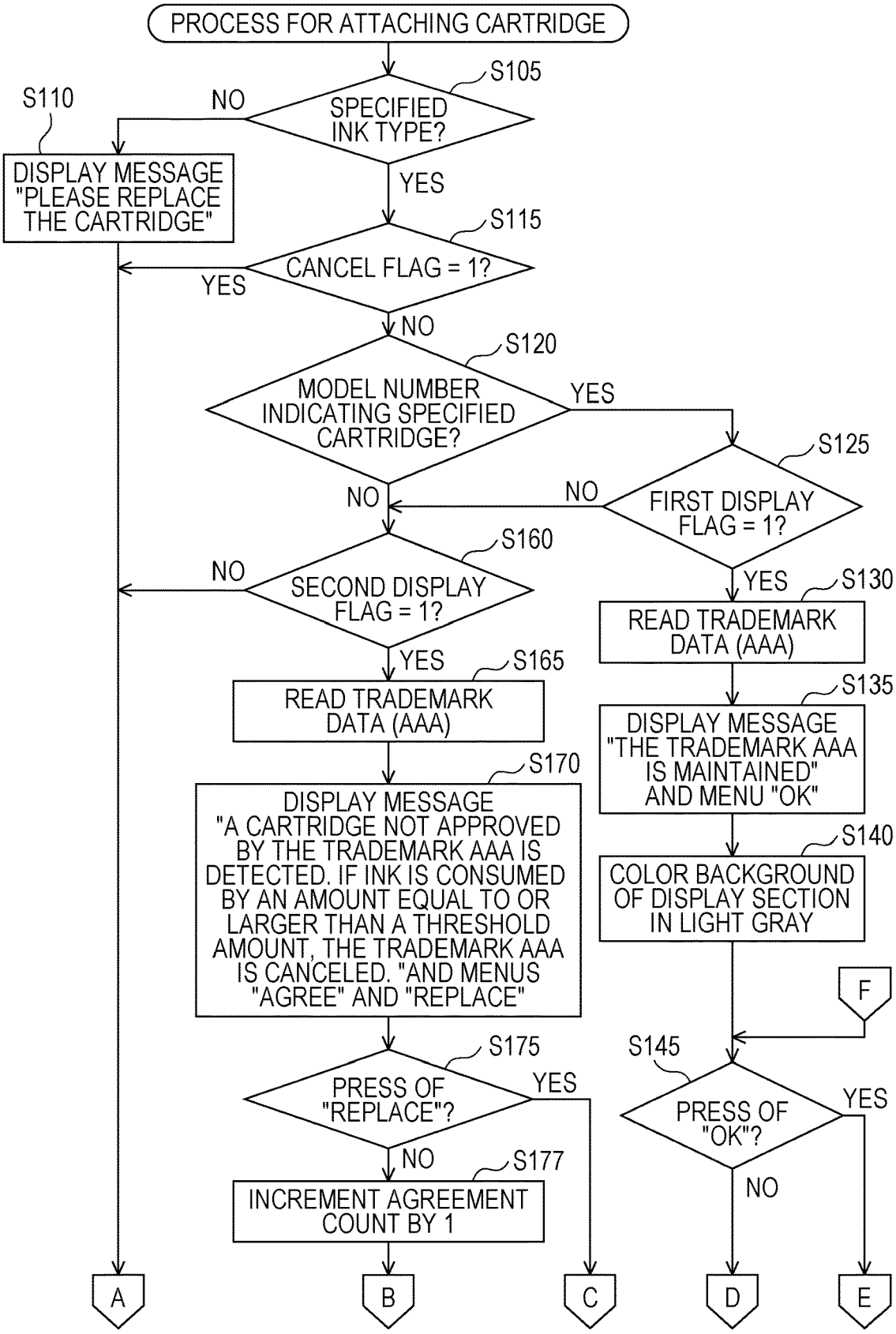
FIG. 9 is a flowchart of a procedure of a process for attaching a cartridge according to the second embodiment.

FIG. 9 is a flowchart of steps of a process for attaching a cartridge according to the second embodiment. The process for attaching a cartridge of the second embodiment is different from that of the first embodiment in that a process in step S177 is additionally executed. The other steps of the process for attaching a cartridge of the second embodiment are the same as those of the first embodiment, and therefore, the same steps of the procedure are denoted by the same reference numerals and detailed descriptions thereof are omitted. Note that, after the steps illustrated in FIG. 9, the steps illustrated in FIG. 7 are executed.

In step S175, when it is determined that a menu button "Replace" has not been selected, that is, when it is determined that the menu button "Agree" has been selected (step S175: NO), the cartridge determination section 122 increments the agreement count stored in the agreement count storage section 135 by one (step S177). After execution of the process in step S177, the process in step S190 of FIG. 7 is executed as described above.

The printer 100*a* of the second embodiment described above has the same effect as the printer 100 of the first embodiment. In addition, since the memory 130 stores the agreement count, a maintenance company may specify the agreement count. Accordingly, the maintenance company may realize provision of a service corresponding to the specified agreement count for the user or research of consumption trend of the user based on the agreement count, for example.

C. Other Embodiments (C1) Although the maintenance subject information, that is, an identifier indicating a cartridge 20 to be used when a maintenance contract is made, is stored in a storage device 222 of a circuit substrate 22 of the cartridge 20 as a control code, the present disclosure is not limited to this. For example, a predetermined code indicating the identifier, such as a QR code (registered trademark) or a bar code, may be printed on an outer surface of an outer shell 21 of the cartridge 20, or a seal member having such a code printed thereon may be attached to the outer surface of the outer shell 21. With this configuration, the carriage 30 may have a functional section which reads the predetermined code, and the functional section reads the predetermined code so that maintenance subject information is obtained. Specifically, in general, the maintenance subject information may be attached to the cartridge 20 by an arbitrary method.

(C2) Although the message displayed in step S195 indicates cancellation of the maintenance contract and further suggests replacement by a specified cartridge in the foregoing embodiments, the present disclosure is not limited to this. The message may indicate only cancellation of the maintenance contract. Alternatively, the message may suggest only replacement by a specified cartridge.

(C3) In step S110, step S135, step S170, step S185, step S195, and step S210 of the foregoing embodiments, instead of the display of the predetermined message in the display section 52 or in addition to the display of the predetermined message in the display section 52, the predetermined message may be output by sound from a speaker 53. Alternatively, predetermined warning sounds corresponding to the predetermined messages may be output from the speaker 53. Furthermore, instead of the predetermined messages, predetermined codes corresponding to the predetermined messages may be displayed in the display section 52. With this configuration, the user may recognize content of the predetermined message by specifying association between the predetermined code and the content with reference to a manual or the like. Furthermore, at least one of the cancellation of the maintenance contract and suggestion of the replacement by a specified cartridge may be informed for the user by another method instead of the display in the display section 52 and the sound output from the speaker 53. Specifically, the cancellation of the maintenance contract and the suggestion of the replacement by a specified cartridge may be informed by controlling a lighting state of a lamp, not illustrated, included in the printer 100 or the printer 100*a* or a warning lamp device provided separately from the printer 100 or the printer 100*a*, for example. Furthermore, when the print control apparatus 500 is constituted by a personal computer of an administrator of the printer 100 or the printer 100*a* and a monitor device, the predetermined message may be displayed in the monitor device. By this display, the administrator may realize that the cartridge has been replaced or the maintenance contract is maintained or canceled due to the replacement. Note that, with this configuration, instead of the configuration in which predetermined software is installed in a personal computer, the personal computer may have a function of the operation section 50. Note that, in this configuration, a system including the printer 100 and the print control apparatus 500 corresponds to a subordinate concept of the consumables consumption system of this disclosure.

(C4) In the foregoing embodiments, the process in step S190 to step S200 may be omitted. In this configuration, a newly-attached cartridge is a similar cartridge or a cartridge 20 to be used when the maintenance contract is not made. When a second display flag of 1 is set, the process in step S210 is executed so that the message "The trademark AAA has been canceled", that is, a message indicating the cancellation of the maintenance contract is displayed in the display section 52. Accordingly, the user may recognize that the maintenance contract has been canceled by checking such a message. Furthermore, also in this configuration, the process in step S220 is executed, and therefore, the cancel flag of 1 is set. Accordingly, when the similar cartridge or the cartridge 20 to be used when the maintenance contract has not been made is replaced by a specified cartridge after that, the process in step S210 is executed so that the message "The trademark AAA has been canceled" is displayed in the display section 52 only when a main-body display flag of 1 is set. Therefore, misunderstanding of the user that the services defined by the maintenance contract may be still available may be suppressed.

(C5) Although the maintenance associated trademark is displayed in the display section 52 as a portion of a predetermined message in step S135, step S170, step S195, and step S210, other maintenance association trademarks may be displayed in the display section 52 in addition to the predetermined message.

(C6) In step S110, step S135, step S170, step S185, step S195, and step S210 of the foregoing embodiments, content of the messages displayed in the display section 52 is not limited to content described in the foregoing embodiments. For example, in step S170, step S195, and step S210, instead of the message indicating the cancellation of the maintenance contract or in addition to the message indicating the cancellation of the maintenance contract, a message indicating that free repair is not available at a time of repair, that is, only fare-paying repair is available, may be displayed. Furthermore, in step S135, instead of the message indicating that the maintenance contract is maintained or in addition to the message indicating that the maintenance contract is maintained, a message indicating that free repair is available at a time of repair may be displayed.

(C7) In the second embodiment, instead of the agreement count or in addition to the agreement count, the number of times the menu button "Replace" is selected may be stored in the memory 130. Alternatively, the number of times the process in step S135 is executed, that is, the number of times the message "The trademark AAA is maintained" is displayed in the display section 52, may be stored in the memory 130. The maintenance company may specify the number and realize provision of a service corresponding to the number for the user or research of consumption trend of the user based on the number.

(C8) In the foregoing embodiments, a cartridge attached to the holder 31 is a specified cartridge, a privilege service may be offered. For example, it is determined that the first display flag of 1 is set in step S125 (step S125: YES), a privilege service may be started separately from the process from step S130 to step S155. Examples of the privilege service include a service in which predetermined points is added every time ink is consumed by a predetermined amount and accumulated points is used in a maintenance service. Furthermore, in this configuration, the privilege service may be terminated when it is determined that "1" has been set in the cancel flag in step S115 (step S115: YES), when it is determined that "1" has not been set in the second display flag in step S160 (step S160: NO), and when it is determined that an ink consumption amount is equal to or larger than a threshold amount in step S200 (step S200: YES).

(C9) In the foregoing embodiments, as a storage mode of trademark data in the trademark data storage section 134, that is, data on a character string AAA, the character string AAA is described in firmware of a control program. However, the present disclosure is not limited to this. For example, a storage section dedicated for storage of the data on the character string AAA may be included in the memory 130 separately from the firmware, and the data on the character string AAA may be stored in the storage section.

(C10) In the foregoing embodiments, at least one of display flags may be omitted among the first display flag, the second display flag, and the main-body display flag. When the first display flag is omitted, the process in step S125 may be omitted and the first display-flag storage section 222*b* may be eliminated. Furthermore, when the second display flag is omitted, the process in step S160 may be omitted and the second display-flag storage section 222*c* may be eliminated. Furthermore, when the main-body display flag is omitted, the process in step S205 may be omitted and the main-body display flag storage section 132 may be eliminated. Furthermore, in this configuration, the process in step S210 may be executed after the process in step S110 is executed or the process in step S215 may be executed without executing the process in step S210.

(C11) Although an ink jet printer is employed as the consumables consumption apparatus of the present disclosure in the foregoing embodiments, an arbitrary consumables consumption apparatus having a cartridge capable of accommodating consumables attached therein may be employed instead of the ink jet printer. For example, a laser printer may be employed as the consumables consumption apparatus. In a configuration thereof, a toner corresponds to the consumables. Furthermore, a multifunction peripheral may be employed instead of the ink jet printer or the laser printer.

(C12) In the foregoing embodiments, a model number for an arbitrary usage may be set in the cartridge 20 separately from a model number used by the cartridge determination section 122 for distinguishing a specified cartridge from an unspecified cartridge. For example, a model number which is used for communication between the manufacturer of the printer 100 and the user and which is easily remembered by the user or a name may be additionally set.

(C13) In the foregoing embodiments, a portion of the configuration realized by hardware may be realized by software, and conversely, a portion of the configuration realized by software may be realized by hardware. For example, at least one of functional sections including the print controller 121, the cartridge determination section 122, the consumption amount comparison section 123, and the notification controller 124 may be realized by an integrated circuit, a discrete circuit, or a module configured by combining the integrated circuit and the discrete circuit. Furthermore, when some of or all the functions of the present disclosure are realized by software, the software (a computer program) which is stored in a computer readable recording medium may be provided. Examples of the "computer readable recording medium" include not only a flexible disc and a mobile recording medium, such as a CD-ROM, but also an internal storage device included in a computer, such as various RAMS or various ROMS, and an external storage device fixed in a computer, such as a hard disk. Specifically, the "computer readable recording medium" has wide meaning including an arbitrary recording medium capable of performing non-transitory fixing on data packets.

D. Other Embodiments

The present disclosure is not limited to the foregoing embodiments and may be realized by various modes without departing from the scope of the disclosure. For example, the present disclosure may be realized by the following mode. Technical features of the foregoing embodiments corresponding to technical features in embodiments described below may be changed or combined where appropriate so that a portion or all the problem of the present disclosure is addressed or a portion or all the effect of the present disclosure is achieved. If the technical features are not described as essential in the specification, the technical features may be deleted where appropriate.

(1) According to an embodiment of the present disclosure, there is provided a consumables consumption apparatus to which a specified cartridge which has maintenance subject information indicating a subject of a maintenance contract and which is capable of accommodating consumables or an unspecified cartridge which does not have the maintenance subject information and which is capable of accommodating the consumables is selectively attached. The consumables consumption apparatus includes a cartridge determination section that determines one of the specified cartridge and the unspecified cartridge which is attached to the consumables consumption apparatus in accordance with the maintenance subject information and a notification section that requests a selection of one of use agreement of the unspecified cartridge and replacement of the unspecified cartridge by the specified cartridge when the cartridge determination section determines that the unspecified cartridge is attached and that makes a notification indicating at least one of information on cancellation of the maintenance contract and information on replacement by the specified cartridge when the use agreement is selected.

The consumables consumption apparatus according to the embodiment requests a selection of one of use agreement of the unspecified cartridge and replacement of the unspecified cartridge by the specified cartridge when the cartridge determination section determines that the unspecified cartridge is attached, and makes a notification indicating at least one of information on cancellation of the maintenance contract and information on replacement by the specified cartridge when the use agreement is selected. Accordingly, the user may recognize at least one of the information on the cancellation of the maintenance contract and the information on the replacement by the specified cartridge when the use agreement is selected to use the unspecified cartridge. Accordingly, the misunderstanding of the user that services defined by the maintenance contract may be still available if a failure occurs in the consumables consumption apparatus although the maintenance contract has been cancelled due to the use of the unspecified cartridge in the past may be suppressed and generation of a problem about maintenance cost may be suppressed.

(2) The consumables consumption apparatus according to the embodiment further includes a consumption amount comparison section that executes comparison between a consumption amount of the consumables after the use agreement is selected and a predetermined threshold amount. The notification section makes a notification indicating that cancellation of the maintenance contract is determined when a result of the comparison indicates that the consumption amount of the consumables is equal to or larger than the threshold amount. According to the consumables consumption apparatus of this embodiment, the notification section notifies the user of a determination of the cancellation of the maintenance contract when a result of the comparison indicates that the consumption amount of the consumables is equal to or larger than the threshold amount, and therefore, the user may recognize that the maintenance contract has been canceled.

(3) The consumables consumption apparatus according to the embodiment may further include a cancel flag storage section that stores a cancel flag indicating that cancellation of the maintenance contract is determined when a result of the comparison indicates that the consumption amount of the consumables is equal to or larger than the threshold amount. According to the consumables consumption apparatus of this embodiment, the cancel flag storage section that stores a cancel flag indicating that cancellation of the maintenance contract is determined when a result of the comparison indicates that the consumption amount of the consumables is equal to or larger than the threshold amount. Accordingly, even when the specified cartridge is attached after that, the fact that the maintenance contract has cancelled may be specified by the cancel flag.

(4) In the consumables consumption apparatus according to this embodiment, the notification section may make a notification indicating that the maintenance contract has been cancelled when the cartridge determination section determines that a cartridge newly attached to the consumables consumption apparatus is the specified cartridge in a state in which the cancel flag is stored in the cancel flag storage section. According to the consumables consumption apparatus of this embodiment, when the unspecified cartridge is attached, consumables accommodated in the unspecified cartridge is consumed by an amount equal to or larger than the threshold amount, and thereafter, the unspecified cartridge is replaced by the specified cartridge, a notification indicating that the maintenance contract has been canceled may be made for the user. Accordingly, the misunderstanding of the user described above may be more reliably suppressed.

(5) In the consumables consumption apparatus according to the embodiment, the notification section may make a notification indicating that the maintenance contract is maintained when the cartridge determination section determines that a cartridge newly attached to the consumables consumption apparatus is the specified cartridge in a state in which the cancel flag is not stored in the cancel flag storage section. According to the consumables consumption apparatus of this embodiment, when the cartridge determination section determines that a cartridge newly attached to the consumables consumption apparatus is a specified cartridge, the user may recognize that the maintenance contract is maintained by a notification indicating that the maintenance contract is maintained.

(6) In the consumables consumption apparatus according to the embodiment, the notification section may make a notification indicating that the maintenance contract is maintained when the cartridge determination section determines that the attached cartridge is the specified cartridge. According to the consumables consumption apparatus of this embodiment, when the cartridge determination section determines that a cartridge newly attached to the consumables consumption apparatus is a specified cartridge, the user may recognize that the maintenance contract is maintained by a notification indicating that the maintenance contract is maintained.

(7) In the consumables consumption apparatus according to the embodiment, the notification section may make a notification indicating that the maintenance contract is maintained when the replacement is selected. According to the consumables consumption apparatus of this embodiment, the notification indicating that the maintenance contract is maintained is made when the replacement is selected, and therefore, the user may recognize that the maintenance contract is not cancelled but maintained since the unspecified cartridge is replaced by the specified cartridge.

(8) In the consumables consumption apparatus according to the embodiment, the notification section may make a notification indicating that the maintenance contract is canceled or maintained along with a notification indicating a trademark associated with a manufacturer of the consumables consumption apparatus. According to the consumables consumption apparatus of this embodiment, since the notification section makes the notification indicating that the maintenance contract is cancelled or maintained along with the notification indicating a trademark associated with the manufacturer of the consumables consumption apparatus, the user may recognize that the notification indicating that the maintenance contract is canceled or maintained is reliable.

(9) The consumables consumption apparatus according to the embodiment may further include an agreement count storage section that stores an agreement count of the use agreement. According to the consumables consumption apparatus of this embodiment, since the agreement count storage section that stores an agreement count of the use agreement is provided, the agreement count may be specified by a maintenance company or the like of the consumables consumption apparatus. Accordingly, the maintenance company may realize provision of a service of content corresponding to the agreement count for the user, for example.

(10) In the consumables consumption apparatus according to the embodiment, the notification section may include an operation panel having at least one of a display section and a speaker. According to the consumable consumption apparatus of this embodiment, when the user is positioned near the consumables consumption apparatus, the notification indicating that the maintenance contract is canceled or maintained may be clearly made.

(11) According to another embodiment of the present disclosure, there is provided a consumables consumption apparatus to which a specified cartridge which has maintenance subject information indicating a subject of a maintenance contract and which is capable of accommodating consumables or an unspecified cartridge which does not have the maintenance subject information and which is capable of accommodating the consumables is selectively attached. The consumables consumption apparatus includes a cartridge determination section that determines one of the specified cartridge and the unspecified cartridge which is attached to the consumables consumption apparatus in accordance with the maintenance subject information and a notification section that requests a selection of one of use agreement of the unspecified cartridge and replacement of the unspecified cartridge by the specified cartridge when the cartridge determination section determines that the unspecified cartridge is attached, and that executes at least one of indication of cancellation of the maintenance contract and suggestion of the replacement when the use agreement is selected.

According to the consumables consumption apparatus of this embodiment, when the cartridge determination section determines that the unspecified cartridge has been detected, a selection of use agreement of the unspecified cartridge or replacement of the unspecified cartridge by the specified cartridge is requested. When the use agreement is selected, at least one of the indication of the cancellation of the maintenance contract and the replacement by the specified cartridge is executed. Accordingly, when the user selects the use agreement to use the unspecified cartridge, at least one of a notification of the cancellation of the maintenance contract and suggestion of replacement by the specified cartridge for suppressing the cancellation of the maintenance contract may be realized. Accordingly, the misunderstanding of the user that services defined by the maintenance contract may be still available if a failure occurs in the consumables consumption apparatus although the maintenance contract has been cancelled due to the use of the unspecified cartridge in the past may be suppressed.

The present disclosure may be realized by various modes. For example, the present disclosure may be realized in modes of a consumables consumption system including the consumables consumption apparatus of one of the foregoing embodiments and an external display device or an external speaker, a method for controlling the consumables consumption apparatus, and a computer program which realizes the method, a recording medium which records the computer program, and the like.

What is claimed is:

1. A consumables consumption apparatus comprising:

a case configured to receive a specified cartridge which has maintenance subject information indicating a subject of a maintenance contract and which is capable of accommodating consumables or an unspecified cartridge which does not have the maintenance subject information and which is capable of accommodating the consumables is selectively attached; and a controller configured to:

determine one of the specified cartridge and the unspecified cartridge which is attached to the consumables consumption apparatus in accordance with the maintenance subject information, request a selection of one of use agreement of the unspecified cartridge and replacement of the unspecified cartridge by the specified cartridge when the cartridge determination section determines that the unspecified cartridge is attached, and make a notification indicating information on cancellation of the maintenance contract and information on replacement by the specified cartridge when the use agreement is selected.

2. The consumables consumption apparatus according to claim 1, wherein the controller is configured to execute comparison between a consumption amount of the consumables after the use agreement is selected and a predetermined threshold amount, and make a notification indicating that cancellation of the maintenance contract is determined when a result of the comparison indicates that the consumption amount of the consumables is equal to or larger than the threshold amount.

3. The consumables consumption apparatus according to claim 2, wherein the controller is configured to store a cancel flag indicating that cancellation of the maintenance contract is determined when a result of the comparison indicates that the consumption amount of the consumables is equal to or larger than the threshold amount.

4. The consumables consumption apparatus according to claim 3, wherein the controller is configured to make a notification indicating that the maintenance contract was cancelled when the controller determines that a cartridge newly attached to the consumables consumption apparatus is the specified cartridge in a state in which the cancel flag is stored.

5. The consumables consumption apparatus according to claim 3, wherein the controller is configured to make a notification indicating that the maintenance contract is maintained when the controller determines that a cartridge newly attached to the consumables consumption apparatus is the specified cartridge in a state in which the cancel flag is not stored.

6. The consumables consumption apparatus according to claim 1, wherein the controller is configured to make a notification indicating that the maintenance contract is maintained when the controller determines that the attached cartridge is the specified cartridge.

7. The consumables consumption apparatus according to claim 1, wherein the controller is configured to make a notification indicating that the maintenance contract is maintained when the replacement is selected.

8. The consumables consumption apparatus according to claim 1, wherein the controller is configured to make a notification indicating that the maintenance contract is canceled or maintained along with a notification indicating a trademark associated with a manufacturer of the consumables consumption apparatus.

9. The consumables consumption apparatus according to claim 3, controller is configured to store an agreement count of the use agreement.

10. The consumables consumption apparatus according to claim 1, further comprising an operation panel having at least one of a display section and a speaker.

11. A consumables consumption system comprising:

the consumables consumption apparatus according to claim 1; and at least one of an external display device which is disposed outside the consumables consumption apparatus and which is operated in accordance with an operation of the notification section and an external speaker.

* * * * *